US011391236B2

(12) United States Patent
Kodama et al.

(10) Patent No.: US 11,391,236 B2
(45) Date of Patent: Jul. 19, 2022

(54) CONTROL METHOD OF INTERNAL COMBUSTION ENGINE AND INTERNAL COMBUSTION ENGINE

(71) Applicant: NISSAN MOTOR CO., LTD., Yokohama (JP)

(72) Inventors: Takayoshi Kodama, Kanagawa (JP); Masaharu Kassai, Kanagawa (JP); Yoshihiko Iwabuchi, Kanagawa (JP)

(73) Assignee: NISSAN MOTOR CO., LTD., Yokohama (JP)

( * ) Notice: Subject to any disclaimer, the term of this patent is extended or adjusted under 35 U.S.C. 154(b) by 16 days.

(21) Appl. No.: 17/046,018

(22) PCT Filed: Apr. 10, 2018

(86) PCT No.: PCT/IB2018/000683
§ 371 (c)(1),
(2) Date: Oct. 8, 2020

(87) PCT Pub. No.: WO2019/197861
PCT Pub. Date: Oct. 17, 2019

(65) Prior Publication Data

US 2021/0071614 A1 Mar. 11, 2021

(51) Int. Cl.
*F02D 41/40* (2006.01)
*F02P 5/12* (2006.01)
*F02D 41/38* (2006.01)

(52) U.S. Cl.
CPC ..... *F02D 41/401* (2013.01); *F02P 5/12* (2013.01); *F02D 2041/389* (2013.01)

(58) Field of Classification Search
CPC ..... F02B 23/101; F02D 2041/0015; F02D 2041/389; F02D 37/02; F02D 41/3023;
(Continued)

(56) References Cited

U.S. PATENT DOCUMENTS 5,058,548 A 10/1991 Morikawa et al.
5,960,767 A * 10/1999 Akimoto ..... F02B 31/00 123/301
(Continued)

FOREIGN PATENT DOCUMENTS

EP 1 898 064 A1 3/2008
JP 3-33422 A 2/1991
(Continued)

OTHER PUBLICATIONS

Shigeo Yamamoto et al., Keys to Understanding Spray-Guided Combustion of a Narrow-Spacing Gasoline Direct Injection SI Engine with a Centrally Mounted Multi-Hole Injector, SAE International Journal of Engines, Oct. 1, 2009, pp. 1408-1419.
(Continued)

*Primary Examiner* — Carl C Staubach
(74) *Attorney, Agent, or Firm* — Foley & Lardner LLP

(57) ABSTRACT

A control method of an internal combustion engine including a spark plug and a fuel injection valve includes starting electric discharge of the spark plug after a gas flow in a direction from a side of the fuel injection valve toward a side of the spark plug is generated at a position of an electric discharge gap of the spark plug due to spray of the fuel injected from the fuel injection valve.

4 Claims, 5 Drawing Sheets

(58) Field of Classification Search
CPC ..... F02D 41/401; F02P 15/10; F02P 5/045; F02P 5/12
See application file for complete search history.

(56) References Cited

U.S. PATENT DOCUMENTS

| | | | | |
|---|---|---|---|---|
| 11,085,393 | B2 * | 8/2021 | Yoshimura | F02D 41/062 |
| 2008/0201063 | A1 | 8/2008 | Reuss et al. | |
| 2008/0245342 | A1 | 10/2008 | Werner | |
| 2009/0194066 | A1 * | 8/2009 | Ashizawa | F02B 25/18 123/295 |
| 2018/0328262 | A1 * | 11/2018 | Iwabuchi | F02P 5/045 |
| 2020/0173417 | A1 * | 6/2020 | Maeda | F02D 41/40 |

FOREIGN PATENT DOCUMENTS

| | | | |
|---|---|---|---|
| JP | 2003-49679 | A | 2/2003 |
| JP | 2007-239550 | A | 9/2007 |
| JP | 2007-270658 | A | 10/2007 |
| JP | 2009-074498 | A | 4/2009 |
| JP | 2010-065548 | A | 3/2010 |
| JP | 4782836 | B2 | 9/2011 |
| WO | WO-2017/081755 | A1 | 5/2017 |

OTHER PUBLICATIONS

Walter F. Piock et al., Ignition Systems for Spray-Guided Stratified Combustion, SAE International Journal of Engines, Apr. 12, 2010, pp. 389-401.

* cited by examiner

CONTROL METHOD OF INTERNAL COMBUSTION ENGINE AND INTERNAL COMBUSTION ENGINE

TECHNICAL FIELD

The present invention relates to a control method of an internal combustion engine and an internal combustion engine.

BACKGROUND ART

JP 4782836 B discloses a technique including performing fuel injection in the form of stratified injection for generating a locally dense ignitable air-fuel mixture in a spark plug region immediately before ignition time. This technique achieves an improvement of ignitability by the local dense air-fuel mixture.

SUMMARY OF INVENTION

In lean combustion performed in a spark ignition internal combustion engine of a direct fuel injection type, the length of an electric discharge channel of a spark plug and the temperature of an air-fuel mixture affect combustion stability.

However, when a fuel injection timing and an ignition timing are excessively close to each other, there is concern that a gas flow generated due to the spray of fuel injected from a fuel injection valve acts to block the extension of the electric discharge channel. Moreover, there is concern that a hot air-fuel mixture cannot be kept away from the wall surface of a combustion chamber due to such a gas flow, so that a cooling loss increases. As a result, there is concern that the combustion stability deteriorates.

The present invention has been made in view of the above-described problems. It is an object of the present invention to improve the combustion stability of the lean combustion.

MEANS FOR SOLVING PROBLEM

A control method of an internal combustion engine according to one aspect of the present invention is the control method of the internal combustion engine including a spark plug and a fuel injection valve directly injecting fuel into a cylinder. The control method includes starting electric discharge of the spark plug after a gas flow in a direction from a side of the fuel injection valve toward a side of the spark plug is generated at a position of an electric discharge gap of the spark plug due to spray of the fuel injected from the fuel injection valve.

A control method of an internal combustion engine according to another aspect of the present invention is the control method of the internal combustion engine including a spark plug and a fuel injection valve directly injecting fuel into a cylinder. The control method includes controlling a fuel injection timing of the fuel injection valve and an ignition timing of the spark plug so that an electric discharge channel generated in an electric discharge gap of the spark plug extends to a side opposite to the fuel injection valve across the spark plug.

According to yet another aspect of the present invention, internal combustion engines corresponding to the control methods of the internal combustion engines above mentioned are provided, respectively.

DESCRIPTION OF EMBODIMENTS

Hereinafter, embodiments of the present invention are described with reference to the accompanying drawings.

Figure 1:
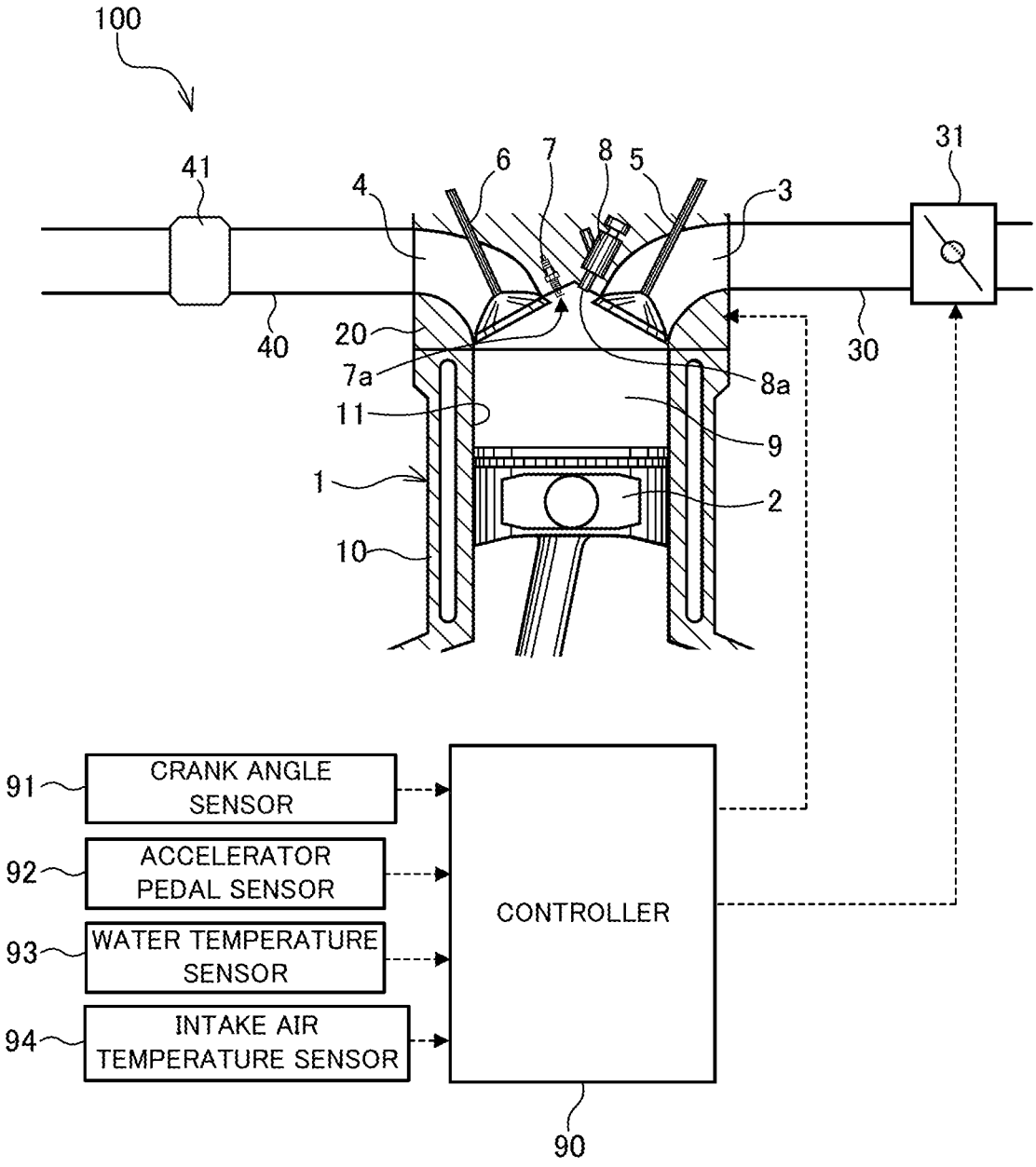
FIG. 1 is a schematic block diagram of an internal combustion engine.

FIG. 1 is a schematic block diagram of an internal combustion engine 100. The internal combustion engine 100 is provided with an internal combustion engine body 1, an intake passage 30, an exhaust passage 40, and a controller 90. Hereinafter, the internal combustion engine body 1 is simply referred to as the body 1.

The body 1 is provided with a cylinder block 10 and a cylinder head 20. In the cylinder block 10, a cylinder 11 is formed. The cylinder 11 houses a piston 2. A combustion chamber 9 is formed as space surrounded by the top surface of the piston 2, the wall surface of the cylinder 11, and the undersurface of the cylinder head 20 and has a pent roof shape. In the combustion chamber 9, an air-fuel mixture burns, so that the piston 2 contacting the combustion chamber 9 receives a combustion pressure to reciprocate in the cylinder 11.

The cylinder head 20 is disposed on the cylinder block 10. In the cylinder head 20, an intake port 3 and an exhaust port 4 are formed. The intake port 3 and the exhaust port 4 communicate with the combustion chamber 9. The intake port 3 supplies intake air. The exhaust port 4 discharges exhaust air from the combustion chamber 9.

In the cylinder head 20, an intake valve 5 and an exhaust valve 6 are provided. The intake valve 5 opens and closes the intake port 3. The exhaust valve 6 opens and closes the exhaust port 4. Two intake ports 3 and two exhaust ports 4 are provided per cylinder. The same applies to the intake valve 5 and the exhaust valve 6.

In a portion between the intake valve 5 and the exhaust valve 6 of the cylinder head 20, a spark plug 7 is provided. The spark plug 7 ignites an air-fuel mixture based on fuel injected by the fuel injection valve 8. The fuel injection valve 8 is provided in the cylinder head 20. The fuel injection valve 8 is provided to directly inject fuel to the inside of a cylinder, i.e., combustion chamber 9.

The spark plug 7 and the fuel injection valve 8 are provided in a region surrounded by the two intake valves 5 and the two exhaust valves 6 when viewed along the extension direction of the cylinder 11. The spark plug 7 and the fuel injection valve 8 are disposed to face the center of an upper portion of the combustion chamber 9. Therefore, electric discharge gap 7*a* of the spark plug 7 and a fuel injection portion 8*a* of the fuel injection valve 8 are located in the center of the upper portion of the combustion chamber 9.

The spark plug 7 is provided on the exhaust side relative to the fuel injection valve 8, i.e., exhaust port 4 side. The spark plug 7 can be disposed on the exhaust port 4 side relative to a top portion of the combustion chamber 9. The fuel injection valve 8 can be disposed on the intake side relative to the top portion of the combustion chamber 9, i.e., intake port 3 side.

The intake passage 30 have the intake air introduced into the internal combustion engine 100 flow. The intake passage 30 leads the intake air to the intake port 3 through an intake manifold. In the intake passage 30, a throttle valve 31 is provided. The throttle valve 31 adjusts the amount of the intake air introduced into the internal combustion engine 100.

The exhaust passage 40 have the exhaust air discharged from the exhaust port 4 through an exhaust manifold flow. In the exhaust passage 40, a catalyst converter 41 is provided. The catalyst converter 41 purifies the exhaust air discharged from the combustion chamber 9 through the exhaust port 4 and the exhaust manifold. To the catalyst converter 41, a three-way catalyst converter is applicable.

The internal combustion engine 100 can be configured as an internal combustion engine in which air introduced into the combustion chamber 9 from the intake passage 30 forms a tumble flow in the combustion chamber 9. The tumble flow is a revolving flow and has a direction from the intake valve 5 side toward the exhaust valve 6 side on the upper side of the combustion chamber 9, i.e., the cylinder head 20 side, and has a direction opposite to the direction above on the lower side of the combustion chamber 9, i.e., the piston 2 side. The direction from the intake valve 5 side toward the exhaust valve 6 side is, in other words, a direction from the fuel injection valve 8 side toward the spark plug 7 side.

The controller 90 is an electronic control unit. Into the controller 90, signals from a crank angle sensor 91, an accelerator pedal sensor 92, a water temperature sensor 93, an intake air temperature sensor 94, and the like are input as various sensors/switches.

The crank angle sensor 91 generates a crank angle signal at each specific crank angle. The crank angle signal is used as a signal representing a revolution speed NE of the internal combustion engine 100. The accelerator pedal sensor 92 detects the stepping amount of an accelerator pedal provided in a vehicle mounted with the internal combustion engine 100. The stepping amount of the accelerator pedal is used as a signal representing a load KL of the internal combustion engine 100. The water temperature sensor 93 detects a cooling water temperature THW of the internal combustion engine 100. The intake air temperature sensor 94 detects the temperature of the intake air supplied to the combustion chamber 9.

The controller 90 is programmed to operate the body 1 according to an engine operating state. The engine operating state is the revolution speed NE and the load KL, for example. The controller 90 operates the body 1 by controlling an ignition timing of the spark plug 7 and fuel injection of the fuel injection valve 8.

In the internal combustion engine 100, lean combustion is performed. In the lean combustion, the length of an electric discharge channel of the spark plug 7 or the temperature of the air-fuel mixture affects combustion stability.

However, when the fuel injection timing and the ignition timing are excessively close to each other, there is concern that a gas flow generated due to the spray of fuel injected from the fuel injection valve 8 acts to block the extension of the electric discharge channel. Moreover, there is concern that a hot air-fuel mixture cannot be kept away from the wall surface of the combustion chamber 9 due to such a gas flow, so that a cooling loss increases. As a result, there is concern that the combustion stability of the lean combustion deteriorates.

In view of such circumstances, the controller 90 performs control described below in this embodiment.

Figure 2:
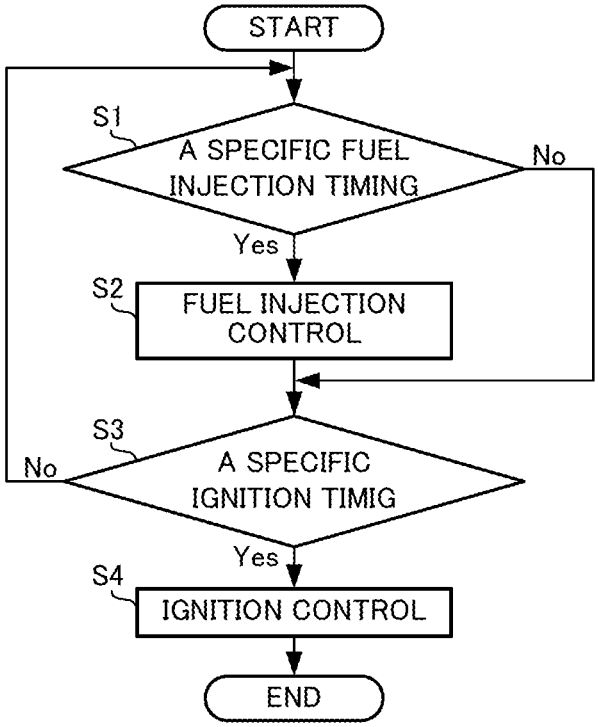
FIG. 2 is a figure illustrating an example of control performed by a controller by a flow chart.

FIG. 2 is a figure illustrating an example of the control performed by the controller 90 by a flow chart. The controller 90 is configured to perform processing of this flow chart, whereby the controller 90 is configured so as to have a control unit. In Step S1, the controller 90 determines whether it is a specific fuel injection timing. In this embodiment, the specific fuel injection timing is configured so as to have a plurality of fuel injection timings.

Therefore, in Step S1, the determination is affirmative when any one of the fuel injection timings included in the specific fuel injection timing arrives. The specific fuel injection timing is further described later. In the case of the affirmative determination in Step S1, the processing proceeds to Step S2.

In Step S2, the controller 90 controls the fuel injection of the fuel injection valve 8. In Step S2, the fuel injection is performed at the fuel injection amount set beforehand according to the fuel injection timing, the arrival of which has been determined in Step S1 immediately before. After Step S2, the processing proceeds to Step S3. The same applies to a case of a negative determination in Step S1.

In Step S3, the controller 90 determines whether it is a specific ignition timing. The specific ignition timing is described later. In the case of a negative determination in Step S3, the processing returns to Step S1. In the case of an affirmative determination in Step S3, the processing proceeds to Step S4.

In Step S4, the controller 90 performs ignition control of the spark plug 7. Thus, electric discharge of the electric discharge gap 7*a* is started. After Step S4, the processing temporarily ends.

The specific fuel injection timing and the specific ignition timing described above are set in order to perform spray-guided weak stratified combustion. The spray-guided weak stratified combustion is an example of the lean combustion and is performed by a combustion system of igniting the spray of injected fuel before the spray of injected fuel reaches the wall surface of the combustion chamber 9 for burning. Such a combustion system is referred to as a spray-guided combustion system.

The spray-guided weak stratified combustion includes fuel injection performed so that the spray of the fuel to be ignited forms a weak stratified air-fuel mixture. In the spray-guided weak stratified combustion, at least one fuel injection is performed for the formation of a homogeneous lean air-fuel mixture during from an intake stroke to the first half of a compression stroke and fuel injection is performed immediately before ignition for the formation of the weak stratified air-fuel mixture. As a ratio of the fuel injection amount to a required fuel injection amount, the amount of fuel injected immediately before the ignition is smaller than the total amount of the fuel injected during from the intake stroke to the first half of the compression stroke.

For example, in the spray-guided weak stratified combustion, about 90 percent of fuel of the required fuel injection amount is injected during from the intake stroke to the first half of the compression stroke and the remaining fuel is injected immediately before the ignition for the formation of the weak stratified air-fuel mixture. Therefore, the amount of the fuel injected for the formation of the stratified air-fuel mixture referred to as the weak stratified air-fuel mixture is considerably smaller than that in the case of injecting most of the fuel of the required fuel injection amount immediately before the ignition to form the stratified air-fuel mixture.

Furthermore, the fuel injection is performed so that an excess air ratio λ of the air-fuel mixture generated in the cylinder is 2 or more. The excess air ratio λ is an excess air ratio of the air-fuel mixture according to the required fuel injection amount, i.e., an excess air ratio of the air-fuel mixture as the entire inside of the cylinder formed based on the total fuel injected into the cylinder per combustion cycle.

In such spray-guided weak stratified combustion, the fuel injection is performed at the predetermined specific fuel injection timing and the ignition is performed at the predetermined specific ignition timing. The specific fuel injection timing and the specific ignition timing are set as follows.

Figure 3A:
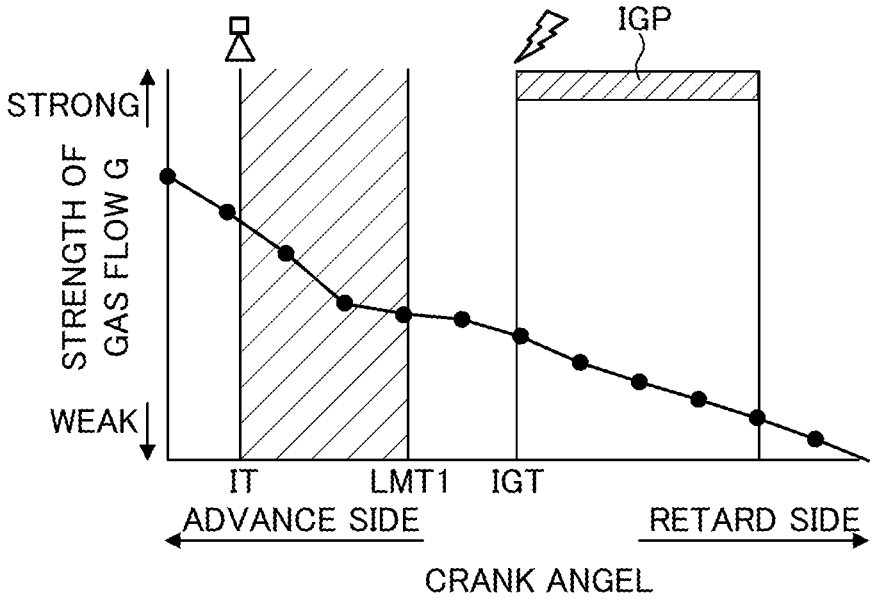
FIG. 3A is a first figure of a first explanatory view of spray-guided weak stratified combustion.
Figure 3B:
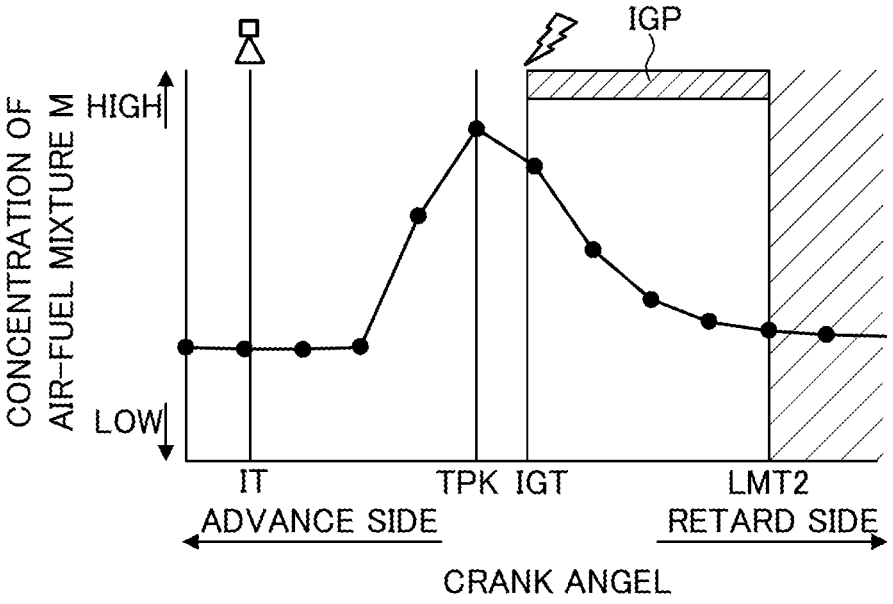
FIG. 3B is a second figure of the first explanatory view of the spray-guided weak stratified combustion.

FIG. 3A and FIG. 3B are first explanatory views of the spray-guided weak stratified combustion. As illustrated in FIG. 3A and FIG. 3B, the specific fuel injection timing includes a fuel injection timing IT. The fuel injection timing IT is set for the formation of the weak stratified air-fuel mixture. The fuel injection timing IT is set so that the weak stratified air-fuel mixture formed by the spray of fuel injected at the fuel injection timing IT is ignited by the spark plug 7. Thus, the fuel injection timing IT is set immediately before the ignition timing of the spark plug 7. The fuel injection timing IT is set in the latter half of the compression stroke.

The specific ignition timing is set as an ignition timing IGT. The ignition timing IGT is an ignition timing for performing the spray-guided weak stratified combustion and is set immediately after the fuel injection timing IT. The ignition timing IGT is set in the latter half of the compression stroke. FIG. 3A and FIG. 3B are further described later.

Next, the spray-guided weak stratified combustion is continuously described further using figures described below.

Figure 4A:
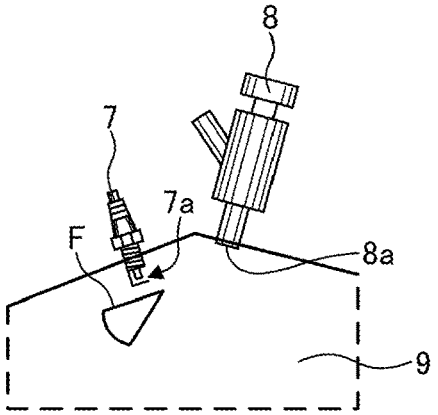
FIG. 4A is a first figure of a second explanatory view of the spray-guided weak stratified combustion.
Figure 4B:
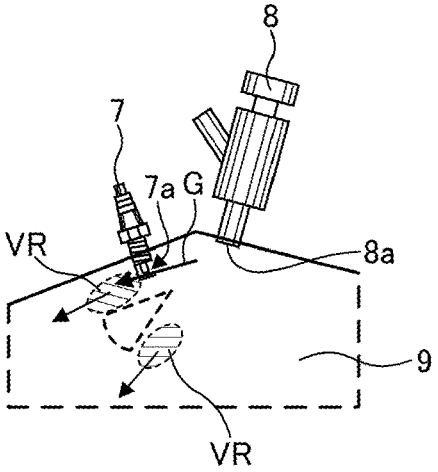
FIG. 4B is a second figure of the second explanatory view of the spray-guided weak stratified combustion.
Figure 4C:
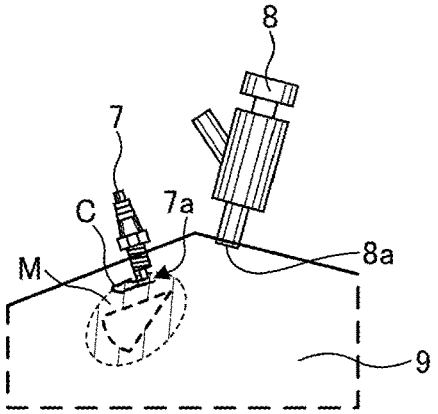
FIG. 4C is a third figure of the second explanatory view of the spray-guided weak stratified combustion.
Figure 5A:
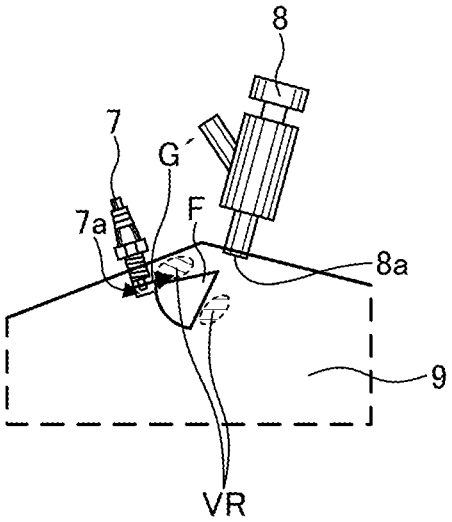
FIG. 5A is a first figure of a figure illustrating Comparative Example.
Figure 5B:
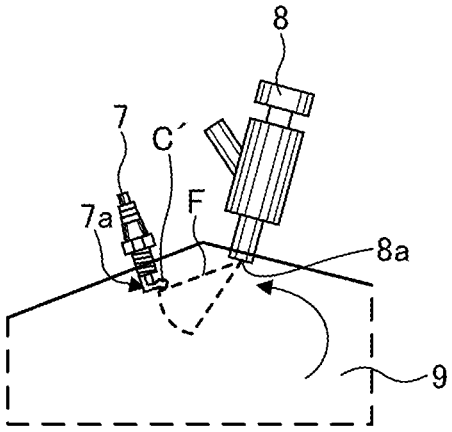
FIG. 5B is a second figure of the figure illustrating Comparative Example.

FIG. 4A to FIG. 4C are second explanatory views of the spray-guided weak stratified combustion. FIG. 5A and FIG. 5B are figures illustrating Comparative Example. Comparative Example illustrates a case where ignition is performed when spray F reaches the electric discharge gap 7*a* of the spark plug 7. The spray F is the spray of the fuel injected at the fuel injection timing IT.

FIG. 4A illustrates a state where the spray F passes the periphery of the electric discharge gap 7*a*. The spray F passes the lower side relative to the electric discharge gap 7*a*, i.e., position on the piston 2 side. The passing positions of the spray F are the following positions.

More specifically, as illustrated in FIG. 4B, while the spray F is formed in the air-fuel mixture, negative pressure regions VR are generated around the spray F due to the spray F. The negative pressure regions VR move with the spray F. The passing positions of the spray F are positions where the negative pressure regions VR pass the electric discharge gap 7*a*.

Thus, a gas flow G in a direction from the fuel injection valve 8 side toward the spark plug 7 side is generated due to the spray F at the position of the electric discharge gap 7*a*. More specifically, the gas flow G is generated at the position of the electric discharge gap 7*a* by a negative pressure action of the negative pressure regions VR generated due to the spray F.

The spark plug 7 and the fuel injection valve 8 are provided at positions where the gas flow G generated due to the spray F is generated at the position of the electric discharge gap 7*a*. More specifically, the generation of the gas flow G at the position of the electric discharge gap 7*a* using the negative pressure regions VR generated due to the spray F is enabled by the setting of the arrangement of the spark plug 7 and the fuel injection valve 8.

When generating the tumble flow in the cylinder, the flow direction of the tumble flow is the same direction as the flow direction of the gas flow G, i.e., direction from the fuel injection valve 8 side toward the spark plug 7 side, at the position of the electric discharge gap 7*a*. Therefore, the gas flow G is not blocked by the tumble flow in this case.

In the state illustrated in FIG. 4B, most of the negative pressure regions VR generated around the spray F due to the spray F pass the position of the electric discharge gap 7*a*. The electric discharge of the electric discharge gap 7*a* is started as illustrated in FIG. 4C thereafter.

As illustrated in FIG. 4C, the electric discharge of the electric discharge gap 7*a* is started while an air-fuel mixture M generated based on the spray F is located at the position of the electric discharge gap 7*a*. Therefore, the ignition timing IGT is set within a period while the air-fuel mixture M is located at the position of the electric discharge gap 7*a*.

When the electric discharge of the spark plug 7 is started, an electric discharge channel C generated in the electric discharge gap 7*a* extends to the side opposite to the fuel injection valve 8 across the spark plug 7 by the gas flow G. Prior thereto, the air-fuel mixture M is kept away from the upper wall surface of the combustion chamber 9 by the gas flow G. As a result, an improvement of the ignitability and a reduction in the cooling loss by the action of the gas flow G are achieved.

As described above, the electric discharge of the electric discharge gap 7*a* is started after most of the negative pressure regions VR pass the position of the electric discharge gap 7*a*. This enables the gas flow G to effectively act on the electric discharge channel C. As a result, the electric discharge channel C stably extends to the side opposite to the fuel injection valve 8 across the spark plug 7 and the extension of the electric discharge channel C is also lengthened.

Meanwhile, when the case of Comparative Example is described, the description is as follows.

In the case of Comparative Example, when the negative pressure regions VR are located between the spark plug 7 and the fuel injection valve 8 as illustrated in FIG. 5A, the electric discharge of the electric discharge gap 7*a* is started. Therefore, when the electric discharge of the electric discharge gap 7*a* is started, a gas flow G' in a direction opposite to the direction of the gas flow G, i.e., gas flow G' in a direction from the spark plug 7 side toward the fuel injection valve 8 side, is generated by the negative pressure regions VR. As a result, an electric discharge channel C' extends to the fuel injection valve 8 side from the spark plug 7 side as illustrated in FIG. 5B.

The negative pressure regions VR move with the spray F, and therefore the gas flow G' becomes the gas flow G thereafter. Hence, the electric discharge channel C' temporarily extends from the spark plug 7 side toward the fuel injection valve 8 side, and then extends to the side opposite to the fuel injection valve 8 across the spark plug 7 as with the electric discharge channel C.

However, such extension of the electric discharge channel C' results in unstable extension through a change in the gas flow direction between the gas flow G' and the gas flow G. Moreover, in this case, the air-fuel mixture M is consequently prevented from keeping away from the wall surface of the combustion chamber 9 by the gas flow G'.

Furthermore, as illustrated in FIG. 5B, when a tumble flow is generated in a cylinder, the flow direction of the gas flow G' faces the flow direction of the tumble flow. Therefore, further in this case, the tumble flow acts to cancel the gas flow G', and then the electric discharge of the electric discharge gap 7*a* is started in such a state.

As a result, this case results in that the extension of the electric discharge channel C' is not stabilized due to the change in the gas flow direction and also, even after the gas flow G' becomes the gas flow G, the extension of the electric discharge channel C' utilizing a period when the strength of the gas flow G is sufficiently large cannot be achieved.

In the light of Comparative Example, the electric discharge of the electric discharge gap 7*a* can be started after the negative pressure regions VR move to a position where the gas flow G' in the direction opposite to the direction of the gas flow G is not generated or after the negative pressure regions VR move to a position where the gas flow G starts to be generated in this embodiment.

The electric discharge channel C can be stably extended even when the electric discharge of the spark plug 7 is started after not the spray F but the negative pressure regions VR completely pass the position of the electric discharge gap 7*a*. However, the strength of the gas flow G generated at the position of the electric discharge gap 7*a* decreases as the negative pressure regions VR are separated from the position of the electric discharge gap 7*a* and the extension of the electric discharge channel C also correspondingly becomes short.

Therefore, it is preferable that the electric discharge of the electric discharge gap 7*a* is started before the negative pressure regions VR completely pass the position of the electric discharge gap 7*a* after the negative pressure regions VR move to the position where the gas flow G' in the direction opposite to the direction of the gas flow G is not generated or after the negative pressure regions VR move to the position where the gas flow G starts to be generated. In other words, it can be said that the ignition timing IGT is set between an advance limit LMT1 and a retard limit LMT2 as described later.

The control of the fuel injection timing of the fuel injection valve 8 and the ignition timing of the spark plug 7 is performed so that the gas flow G acts on the electric discharge channel C and the air-fuel mixture M as described using FIG. 4C. Such control is performed by setting the fuel injection timing of the fuel injection valve 8 to the fuel injection timing IT and setting the ignition timing of the spark plug 7 to the ignition timing IGT as illustrated in FIG. 3A and FIG. 3B.

Meanwhile, in the spray-guided weak stratified combustion, the strength of the gas flow G and the concentration of the air-fuel mixture M have the following change tendencies as illustrated in FIG. 3A and FIG. 3B. More specifically, the strength of the gas flow G has a change tendency of gradually decreasing according to time. The concentration of the air-fuel mixture M has a change tendency of rising and falling to form a peak value after the fuel injection.

In the light of such circumstances, the ignition timing IGT can be set between the advance limit LMT1 illustrated in FIG. 3A and the retard limit LMT2 illustrated in FIG. 3B.

The advance limit LMT1 is the earliest ignition timing among the ignition timings when the gas flow G' in the direction opposite to the direction of the gas flow G is not generated or an ignition timing when the gas flow G starts to be generated. Therefore, in a region after the fuel injection timing IT and on the advance side relative to the advance limit LMT1, the electric discharge channel C' extending from the spark plug 7 side toward the fuel injection valve 8 side is formed.

The retard limit LMT2 is a timing when not the negative pressure regions VR but the spray F completely passes the position of the electric discharge gap 7*a*. This is because, when the spray F completely passes the position of the electric discharge gap 7*a*, the air-fuel mixture M is not present at the position of the electric discharge gap 7*a*, which makes the fuel injection performed at the fuel injection timing IT immediately before ignition meaningless. Therefore, an ignition period IGP ends at the retard limit LMT2. In the ignition period IGP, an improvement of the ignitability to the air-fuel mixture M is achieved by repeating the electric discharge of the electric discharge gap 7*a*.

Upon achieving an improvement of the ignitability by the extension of the electric discharge channel C in the spray-guided weak stratified combustion, the balance between the strength of the gas flow G and the concentration of the air-fuel mixture M can be held within the allowable level by setting the ignition timing IGT between the advance limit LMT1 and the retard limit LMT2.

When most of the negative pressure regions VR pass the position of the electric discharge gap 7*a*, the concentration of the air-fuel mixture M forms a peak value. Therefore, by setting the ignition timing IGT on the retard side relative to a timing TPK when the concentration of the air-fuel mixture M forms the peak value, the electric discharge of the electric discharge gap 7*a* can be started after most of the negative pressure regions VR pass the position of the electric discharge gap 7*a*.

Next, main operational effects of this embodiment are described.

The control method of the internal combustion engine according to this embodiment is a control method of the internal combustion engine 100 provided with the spark plug 7 and the fuel injection valve 8 and includes starting the electric discharge of the spark plug 7 after the gas flow G in the direction from the fuel injection valve 8 side toward the spark plug 7 side is generated at the position of the electric discharge gap 7*a* due to the spray F.

Moreover, the control method of the internal combustion engine according to this embodiment is a control method of the internal combustion engine 100 provided with the spark plug 7 and the fuel injection valve 8 and includes controlling the fuel injection timing of the fuel injection valve 8 and the ignition timing of the spark plug 7 so that the electric discharge channel C generated in the electric discharge gap 7*a* extends to the side opposite to the fuel injection valve 8 across the spark plug 7.

According to these methods, the ignition can be performed by causing the negative pressure produced by the spray F to affect the flow velocity of the gas around the spark plug 7 to thereby promote the gas flow G in the direction from the fuel injection valve 8 side toward the spark plug 7 side. Therefore, an improvement of the ignitability can be achieved by extending the electric discharge channel of the spark plug 7 by the gas flow G. Moreover, a reduction in the cooling loss can be achieved by keeping a hot stratified air-fuel mixture away from the wall surface of the combustion chamber 9 by the gas flow G. As a result, these achievements can improve the combustion stability of the lean combustion.

The control method of the internal combustion engine 100 further includes performing the fuel injection from the fuel injection valve 8 so that the excess air ratio $\lambda$ is 2 or more.

More specifically, the control method of the internal combustion engine 100 can improve the combustion stability by achieving the reduction in the cooling loss and the improvement of the ignitability in the lean combustion, including the spray-guided weak stratified combustion, in which such fuel injection is performed.

In the control method of the internal combustion engine 100, the operation is performed by providing the spark plug 7 and the fuel injection valve 8 at the positions where the gas flow G generated in the cylinder due to the spray F is generated at the position of the electric discharge gap 7*a*. Thus, the operation is performed by setting the arrangement of the spark plug 7 and the fuel injection valve 8, whereby the gas flow G can be promoted using the negative pressure produced by the spray F, so that the ignition can be performed.

In the control method of the internal combustion engine 100, the electric discharge of the spark plug 7 is started after most of the negative pressure regions VR generated around the spray F due to the spray F pass the position of the electric discharge gap 7*a*. Thus, the electric discharge channel C can be stably extended long to the side opposite to the fuel injection valve 8 across the spark plug 7, and therefore the combustion stability of the lean combustion can be greatly improved.

As described above, the embodiments of the present invention are described. However, the embodiments merely exemplify some of application examples of the present invention and do not intend to limit the technical scope of the present invention to the specific configurations of the embodiments described above.

The embodiments described above describe the case where the specific fuel injection timing is configured so as to have the plurality of timings including the fuel injection timing IT. However, the specific fuel injection timing may be only the fuel injection timing IT, for example. Moreover, the lean combustion may be lean combustion other than the spray-guided weak stratified combustion.

The embodiments described above describe the case where, with respect to the spark plug 7 and the fuel injection valve 8 disposed to face the center of the upper portion of the combustion chamber 9, the spark plug 7 is provided on the exhaust side relative to the fuel injection valve 8. However, the spark plug 7 may be provided on the intake side relative to the fuel injection valve 8, for example. Moreover, the internal combustion engine 100 may be configured to generate a tumble flow rotating in a direction opposite to the direction of the tumble flow described in the embodiments in place of the tumble flow.

The embodiments described above describe the case where the control method and the control unit of the internal combustion engine 100 described are realized by the controller 90. However, the control method and the control unit of the internal combustion engine 100 may be realized by a plurality of controllers, for example.

The invention claimed is:

1. A control method of an internal combustion engine including a spark plug and a fuel injection valve directly injecting fuel into a cylinder, the spark plug and the fuel injection valve being provided at positions where a first gas flow in a direction from a side of the fuel injection valve toward the spark plug is generated at a position of an electric discharge gap of the spark plug due to a spray of fuel injected from the fuel injection valve, the control method comprising:

controlling a fuel injection timing of the fuel injection valve and an ignition timing of the spark plug so that an electric discharge channel generated in the electric discharge gap of the spark plug extends to a side opposite to the fuel injection valve across the spark plug by performing a fuel injection in which the first gas flow and a second gas flow in a direction opposite to a direction of the first gas flow are generated at the position of the electric discharge gap by a negative pressure action of a negative pressure region generated around the spray due to the spray and moving with the spray, the second gas flow becoming the first gas flow thereafter, and setting the ignition timing of the spark plug to a timing between a timing when the first gas flow starts to be generated and a timing when the spray completely passes the position of the electric discharge gap, the timing when the first gas flow starts to be generated being an advance limit.

2. The control method of the internal combustion engine according to claim 1 comprising:

performing fuel injection from the fuel injection valve so that an excess air ratio of an air-fuel mixture generated in the cylinder is 2 or more.

3. The control method of the internal combustion engine according to claim 1, comprising:

starting electric discharge of the spark plug after most of the negative pressure region passes a position of the electric discharge gap of the spark plug.

4. An internal combustion engine including a spark plug and a fuel injection valve directly injecting fuel into a cylinder, the spark plug and the fuel injection valve being provided at positions where a first gas flow in a direction from a side of the fuel injection valve toward the spark plug is generated at a position of an electric discharge gap of the spark plug due to a spray of fuel injected from the fuel injection valve, the internal combustion engine comprising:

a controller configured to control a fuel injection timing of the fuel injection valve and an ignition timing of the spark plug so that an electric discharge channel generated in the electric discharge gap of the spark plug extends to a side opposite to the fuel injection valve across the spark plug by performing a fuel injection in which the first gas flow and a second gas flow in a direction opposite to a direction of the first gas flow are generated at the position of the electric discharge gap by a negative pressure action of a negative pressure region generated around the spray due to the spray and moving with the spray, the second gas flow becoming the first gas flow thereafter, and setting the ignition timing of the spark plug to a timing between a timing when the first gas flow starts to be generated and a timing when the spray completely passes the position of the electric discharge gap, the timing when the first gas flow starts to be generated being an advance limit.

* * * * *